United States Patent [19]

Wickwire

[11] 4,071,985

[45] Feb. 7, 1978

[54] ARCH AND BUILDING CONSTRUCTION

[76] Inventor: Chester F. Wickwire, 90 S. Main St., Homer, N.Y. 13077

[21] Appl. No.: 667,628

[22] Filed: Mar. 17, 1976

[51] Int. Cl.[2] ..... E04B 1/32

[52] U.S. Cl. ..... 52/86; 52/80

[58] Field of Search ..... 52/80, 81, 86

[56] References Cited

U.S. PATENT DOCUMENTS

| | | | |
|---|---|---|---|
| 2,271,451 | 1/1942 | Blaski | 52/86 |
| 2,705,349 | 4/1955 | Shaw | 52/81 |
| 2,897,668 | 8/1959 | Graham | 52/81 |
| 2,982,290 | 5/1961 | Hanziker | 52/81 |
| 3,203,144 | 8/1965 | Fuller | 52/81 |
| 3,505,765 | 4/1970 | Blaski | 52/86 |
| 3,531,851 | 10/1970 | Douglas | 52/86 |
| 3,546,826 | 12/1970 | Chapman | 52/80 |
| 3,594,964 | 7/1971 | Clark | 52/81 |
| 3,820,292 | 6/1974 | Fitzpatrick | 52/81 |

FOREIGN PATENT DOCUMENTS

| | | | |
|---|---|---|---|
| 972,124 | 8/1975 | Canada | 52/81 |
| 1,016,266 | 1/1966 | United Kingdom | 52/86 |

*Primary Examiner*—Ernest R. Purser
*Assistant Examiner*—Henry Raduazo
*Attorney, Agent, or Firm*—D. Peter Hochberg

[57] ABSTRACT

An arch comprising a plurality of pairs of trapezoidal panels, the panels having short and long opposite parallel sides, and the long parallel sides of the panels in each pair being in an abutting relationship. The nonparallel sides of the trapezoidal panels of adjacent pairs of panels abut one another, and a plurality of the abutting pairs of panels form the arch. The arches can be constructed side-by-side to form a pleated building.

4 Claims, 7 Drawing Figures

ARCH AND BUILDING CONSTRUCTION

BACKGROUND OF THE INVENTION

1. Field of the Invention

This invention relates to static structures, and in particular to the construction of arches and buildings comprising arches.

2. Description of the Prior Art

Conventional buildings, including those designed to enclose very large spaces, incorporate a set of interconnected, flat, vertical walls which support a roof. Vertical internal support for roofs is generally provided by means of interior vertical walls or columns. In order to provide large, open interior spaces unobstructed by interior supports, resort has been had to generally cylindrical, vertical, exterior walls which support a domed roof, and to a variety buildings which are themselves of dome or vault construction. Folded plate structures such as geodesic domes and the like are also well known in the art as strong and effective buildings. U.S. Pat. No. 3,820,292 describes a particularly strong and economical dome structure which comprises a set of abutting segments, each composed of a plurality of trapezoidal panels of decreasing size, corresponding panels on adjacent segments defining rings of panels.

There are many situations which call for strong, elongate structures enclosing unobstructed interior spaces, and for which dome constructions are not entirely adequate. Elongate buildings are known which include aligned arch-like support members over which a generally cylindrical covering fabricated from materials dependent upon the intended use of the building is disposed. Such covering is for example of sheet metal or reinforced concrete construction. Although such buildings are known which are self supporting in that they do not require interior support members, the expense associated with the support members and the foundation for the building render them uneconomical for many applications.

SUMMARY OF THE INVENTION

It is an object of the present invention to provide a strong arch construction which can be utilized in the construction of an elongate building.

Another object of the invention is to provide a strong building which does not require interior support members.

A further object is to provide a strong elongate building which can be fabricated from light-weight materials.

Still another object is the provision of a building of the foregoing type which is susceptible of very large size yet of sufficient strength to resist external forces such as those exerted by wind pressure and snow loads.

Another object is a building construction which can be utilized in building structures of many shapes, and which is susceptible of modification according to a variety of spatial requirements.

It is also an object of this invention to provide an arch construction which is susceptible of fabrication from a plurality of identical panels.

An additional object is to provide a construction of the foregoing type which can be economically constructed using conventional techniques and materials.

Other objects will be apparent to those skilled in the art to which the invention pertains from the description to follow and from the appended claims.

The foregoing objects are achieved by the provision of an arch construction incorporating a plurality of pairs of trapezoidal panels, each pair having two like panels whose corresponding long parallel sides are in an abutting relationship. The non-parallel, connected sides of each pair of panels abut corresponding sides of an adjacent pair of panels. The abutting pairs of panels collectively form the arch. A plurality of arches can be juxtaposed in a side-by-side relationship to form a pleated building structure whose interior space can be unobstructed by interior support members.

DESCRIPTION OF THE PREFERRED EMBODIMENT

The preferred embodiment of the invention comprises an elongated building composed of a plurality of similar arches juxtaposed in a side-by-side relationship. Each arch comprises a plurality of pairs of like trapezoidal panels, the long parallel side of each panel abutting the corresponding side of the other member of the pair. The abutting, long parallel edges of the pairs of panels in each arch thus define a central ridge. The short parallel sides of the panels abut corresponding sides of panels in the adjacent arch, and these abutting, short edges define a valley between the arches. The building itself can thus be characterized as a folded or pleated building having alternating ridges and valleys. The structure has great strength established by the panels themselves, there being no need for interior supports or other support beams.

Figure 1:
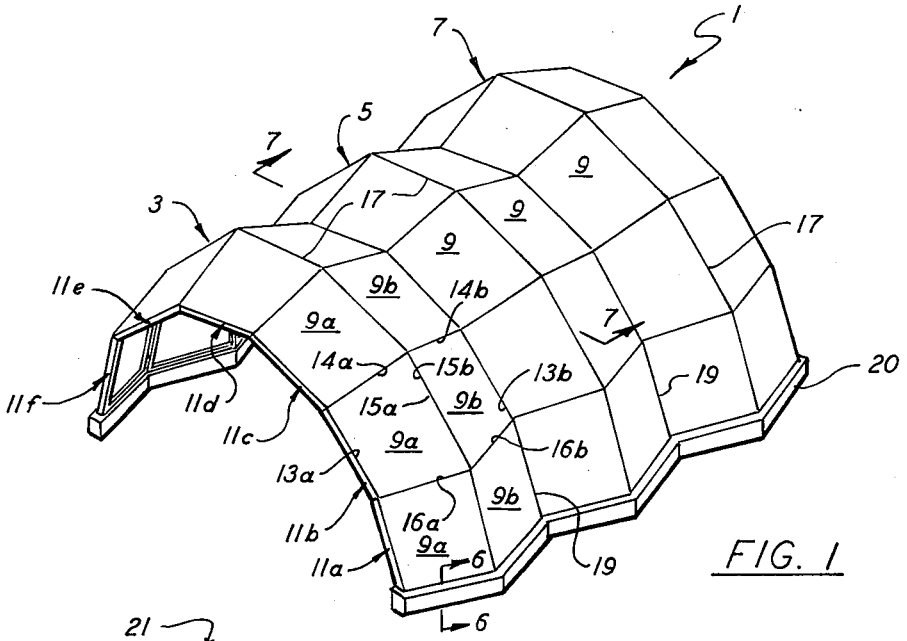
FIG. 1 is a perspective view of an elongate building incorporating structure according to the invention.

Referring first to FIG. 1, there is illustrated an elongate structure 1 according to the preferred embodiment. Structure 1 comprises a plurality of juxtaposed arches 3, 5, and 7. Each arch 3–7 is composed of a plurality of pairs of trapezoidal panels 9. Considering arch 3 as typical of the arches forming structure 1, it may be seen to include adjacent pairs 11*a*–11*f* of panels 9. Each pair 11*a*–11*f* includes identical panels 9*a* and 9*b*, which respectively have sides 13*a*–16*a* and 13*a*–16*b*. Sides 13*a* and 15*a* of panel 9*a*, and sides 13*b* and 15*b* of panel 9*b* are parallel, with sides 13*a* and 13*b* being equal in length and shorter than sides 15*a* and 15*b*. Sides 15*a* and 15*b* are equal in length, and in an opposing, abutting relationship. The aligned non-parallel sides (corresponding to sides 14*a*, 14*b* and 16*a*, 16*b*) of the pairs 11*a*–11*f* of panels 9 are in an opposing, abutting relationship with the corresponding non-parallel sides of the adjacent pairs of panels within the arch. The aligned junctures of the abutting long, parallel sides (corresponding to sides 15*a* and 15*b*) collectively define an arch-like ridge 17. By virtue of the construction of arches 3, 5, and 7, they are rigid, sturdy, and self-supporting. Arch 3 is in a juxtaposed relation with arch 5, with the short parallel sides (corresponding to side 13*b*) being in an opposed, abutting relationship with corresponding sides (corresponding to side 13*a*) of the panels in arch 5. The aligned junctures of the abutting, short, parallel sides of the panels in adjacent arches 3 and 5 collectively define an arch-like valley 19. Any number of other arches, such as arch 7, can abut the exposed sides of other arches to increase the size of structure 1; moreover, the arches add end support to each other. The base of the structure rests on an appropriate foundation 20, which does not form part of the present invention.

The substantial strength of the arches and of the building structure according to the invention can be attributed to several factors. Shear forces exist in the planes of the panels in a direction perpendicular to the edges and valleys of the structure. There are also bending stresses in the planes of the panels which yield in-plane moments in the panels. Various membrane forces add further strength to the structure. The membrane forces all lie in the plane of the various panels and result in direct tension or compression stresses. Some of these membrane forces are meridianal and act on the joints of the structure. The resultant of the meridianal forces is at the foundation of the structure. Any end restraint on the structure would yield endwise forces. The folded plate construction additionally procides stiffness against buckling and secondary moments. Thus, a building construction according to this invention is capable of sustaining substantial external loads such as might be expected from snow and wind.

In some situations, it is advantageous to increase the vertical orientation of those panels adjacent base 20, both to increase strength of the building to support vertical loads (such as snow and the weight of the building) and to increase the head space at the periphery of the interior of the building structure. In order to achieve the foregoing orientation, the angles formed by non-parallel sides 16*a* and 16*b* with long parallel sides 15*a* and 15*b* respectively, and the corresponding angles in end panels 9*a* and 9*b* adjacent base 20, are made more acute than the corresponding angles in the centrally disposed panels between the ends of arch 3. Similar provision can be made at the other end of arch 3, and in arches 5 and 7 as well.

Figure 2:
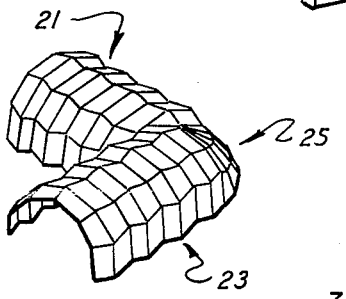
FIG. 2 is a perspective view of an L-shaped building incorporating structure according to the invention.

Structure 1 is an elongate construction, but many variations are possible. For example, groups of arches of the foregoing type can be disposed transversely to each other with appropriate joining structure between the groups. FIG. 2 illustrates an L-shaped building comprising aligned groups of arches 21 and 23, each constructed in the manner of arch 3 (FIG. 1), and joined by a construction 25 which can, for example, comprise one quarter of the dome construction described in previously-mentioned U.S. Pat. No. 3,820,292.

Figure 3:
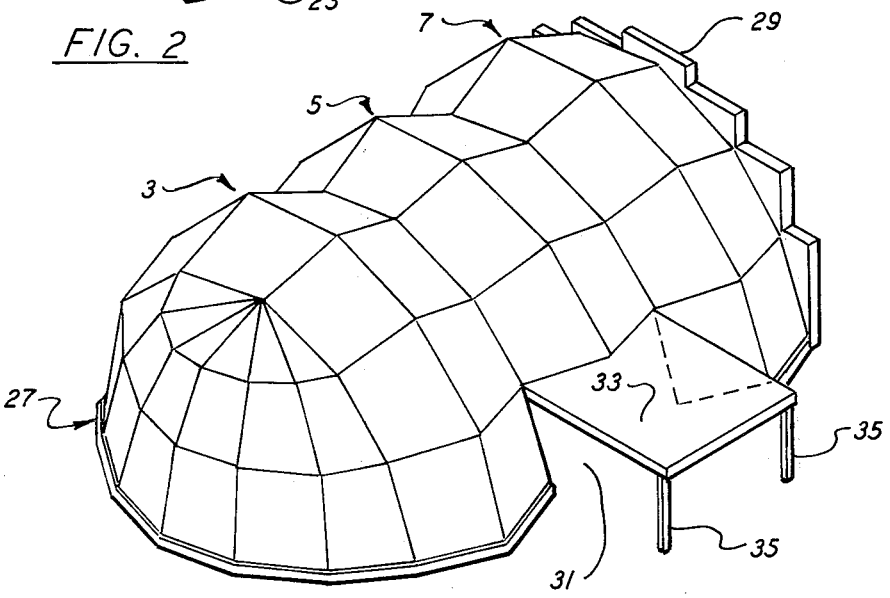
FIG. 3 is an elongate building incorporating structure according to the invention and closed at one end by a portion of a segmented dome.

For many applications, the foregoing arch constructions should be closed at at least one end thereof. Several means for closing the open ends of structure 1 are depicted in FIG. 3. An end of arch 3 is shown closed by a portion 27 of a dome as taught by U.S. Pat. No. 3,820,292. Dome portion 27 not only increases the volume of the structure, but is inherently strong and adds end support to the arches. A simple way to close such arches is by means of a flat wall 29 secured to an open end of the structure. Wall 29 could be the wall of another structure, a natural object such as the side of a hill, or the like. When all open ends of such structures are closed, it is of course normally necessary to provide access to the interior thereof. Hence, one arrangement is shown in FIG. 3, wherein two of panels 9 have been omitted to create an opening 31 in the enclosure and a protective canopy 33 supported by columns 35 is provided near the opening.

Figure 4:
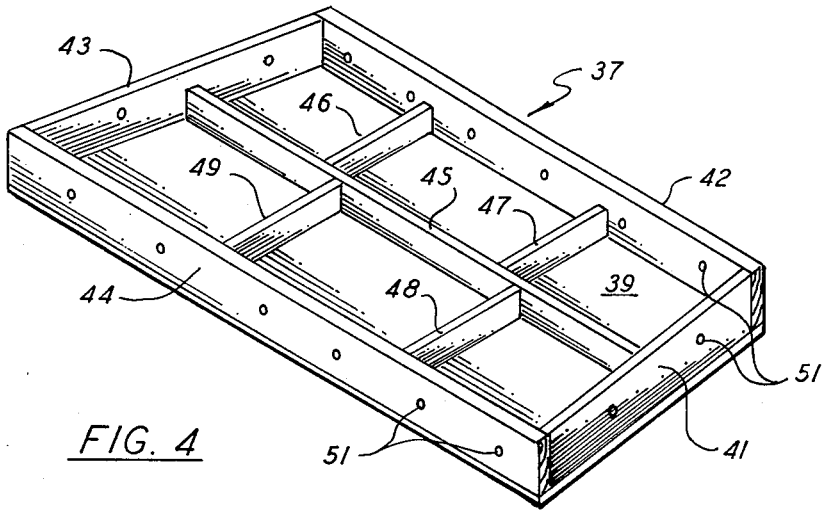
FIG. 4 is a perspective view of a panel used in constructing structures according to the invention.

A major advantage of the invention is that the arches provided thereby can be constructed from identical or similar panels of very simple construction using commonplace materials. A typical panel 37 of the type used in constructing structure 1 (FIG. 1) is shown in FIG. 4. The illustrated view of panel 37 shows the side of the panel which would face the interior of structure 1. Panel 37 comprises a flat sheet 39 of substantially rigid material such as plywood, a plurality of support members 41–44 secured to sheet 39 for strengthening the sheet and for providing abutment surfaces to which corresponding surfaces of adjacent panels can be attached, and a set of support ribs 45–49 for adding strength and rigidity to sheet 39 and to support members 41–44. In the arrangement shown, rib 45 is a centrally disposed, and ribs 46–49 extend transversely therefrom. Members 41–44 and ribs 45–49 can be fabricated from ordinary lumber studs of common cross sectional dimensions such as 2 × 4, 2 inch × 6 inch or 2 × 8 inch. These pieces can be connected by conventional fasteners such as bolts, nails, screws or adhesives. Sides 41–44 are provided with drilled holes 51 which are dimensioned to receive appropriate bolts or other fasteners for securing the panel to adjacent panels in a building structure.

Figure 5:
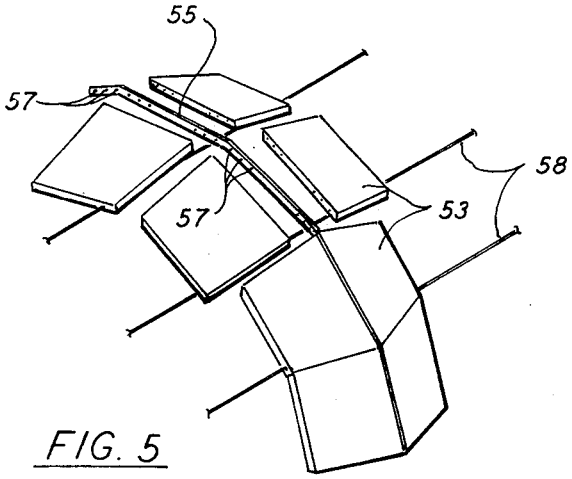
FIG. 5 is an exploded view of an arch according to the invention.

The manner in which the panels can be secured together is shown in FIG. 5. The figure shows an exploded view of an arch constructed according to the invention, and includes a plurality of panels 53 preferably constructed as shown in FIG. 4. Although the panels could be bolted directly together, it is sometimes desirable to add strength and rigidity to the structure by the provision of flitch plates 55 at the meridianal junctures of adjacent pairs of panels. The flitch plates are disposed between panels being joined together, and comprise flat metal plates dimensioned to the approximate edge thickness of the panels they engage. Plates 55 are provided with bolt holes 57 for receiving the connecting bolts which secure the panels together. Flitch plates 55 can be in the form of arches as shown or they can be shorter members disposed intermittently in the panel junctures forming the ridges and valleys of the structure.

An elongated building structure according to the invention usually has sufficient end support by virtue of the inherent strength of the various arches comprising the structure, and by virtue of the end walls normally closing the open end arches. In order to supplement the foregoing or in the event inadequate supporting end structure is provided, cables 58 can be utilized to connect the opposite end arches of the building structure and in effect hold these arches together, so as to add end support to the structure.

Figure 6:
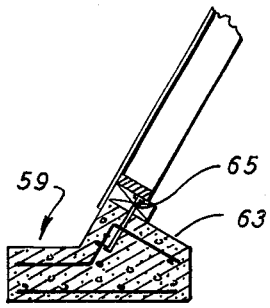
FIG. 6 is a detailed, cross-sectional view taken at the section 6—6 in FIG. 1.

A conventional concrete foundation is an appropriate base for arches and building structures according to the invention. An appropriate foundation 59 (corresponding to base 20 in FIG. 1) is depicted in cross-section in FIG. 6. Foundation 59 is fabricated from steel reinforced concrete, and includes a support surface 63 transverse to the plane of the panel in contact therewith. The panel is shown secured to foundation 59 by a plurality of pins or bolts 65.

Figure 7:
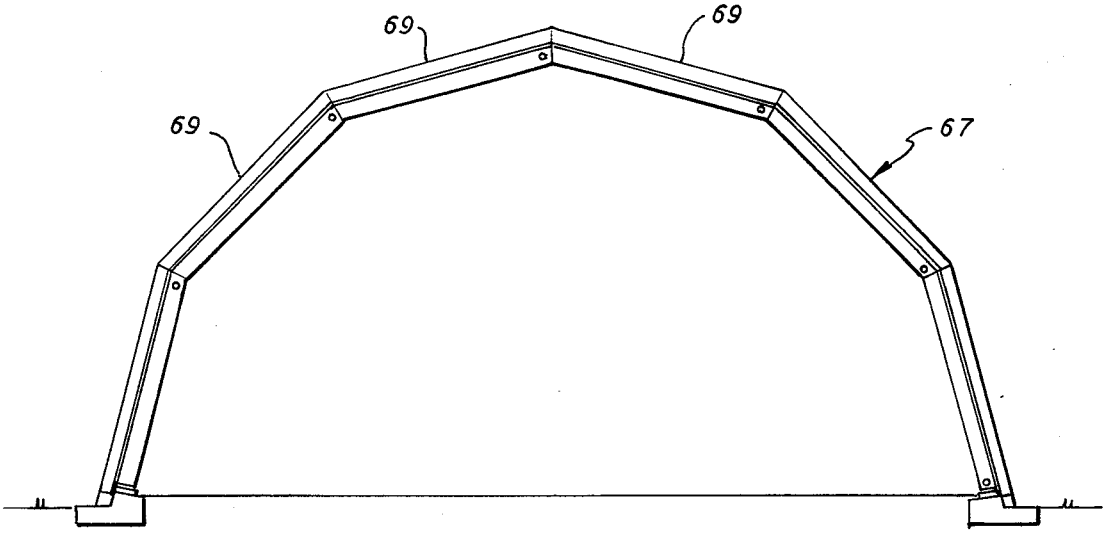
FIG. 7 is a cross-sectional view taken at the section 7—7 in FIG. 1.

An arch 67 according to the preceding description is illustrated in cross section in FIG. 7. The arch as shown comprises six pairs of trapezoidal panels 69, and is supported on a reinforced concrete foundation. Pairs of panels 69 are generally similar, but their angular relationship can be varied to modify the profile of the building.

The construction provided herein is sturdy, capable of enclosing large volumes, and susceptible of extremely economical manufacture. It can be constructed by persons of ordinary building skill, using conventional tools and materials. The invention has been described in detail with particular reference to preferred embodiments, but variations and modifications may occur to those skilled in the art to which the invention pertains.

I claim:

1. A building structure comprising a plurality of rigid arches, wherein:

the arches comprise pairs of wooden panels;

the pairs of panels each including first and second wooden trapezoidal panels; each of said first and second panels comprising a flat sheet of substantially rigid material having a trapezoidal configuration and including one long parallel side, one short parallel side opposite the long parallel side, and non-parallel sides connecting the ends of said long parallel side with the corresponding ends of the short parallel side, and a plurality of support members extending along the borders of the panel and being substantially perpendicular to the panel; the first and second panels of each pair of panels being contiguous, with the long parallel sides of the first and second panels being in an opposed, abutting relationship; and reinforcing means disposed between said first and second panels; and each pair of panels being in an abutting relationship with another of said pairs of panels, with the non-parallel sides of each of said abutting pairs of panels being in an opposed, abutting relationship with each other; the abutting pairs of panels collectively forming the arch; the arch being bounded on its sides by the short parallel sides of the panels forming the arch; and said arches being juxtaposed in a side-by-side relationship with the short parallel sides of the arches abutting corresponding short parallel sides in adjacent arches, said arches collectively forming said building structure.

2. The invention according to claim 1 wherein said building structure includes an end arch having an end surface forming an end of said juxtaposed arches, and a portion of a dome construction extending from said end surface to form an end wall of said building structure.

3. The invention according to claim 1 wherein said building structure comprises first and second sets of said juxtaposed arches, each of said first and second sets forming an elongate structure, and said first and second sets being in an intersecting angular relationship and meeting at a juncture.

4. The invention according to claim 1 wherein at least one of the arches forming said building structure terminates at opposite end pairs of panels, and wherein the non-parallel sides of the respective panels forming at least one of said end pairs of panels and of the abutting non-parallel sides of the pair of panels adjacent said one end pair, form angles with the long parallel sides of the panels in said end pair of panels and in said adjacent pair of panels, which angles are more acute than corresponding angles in pairs of panels centrally disposed between said end pairs, and said one end pair of panels having a more vertical orientation than said centrally disposed pairs of panels.

* * * * *